US006578819B2

(12) United States Patent
Chapman

(10) Patent No.: US 6,578,819 B2
(45) Date of Patent: Jun. 17, 2003

(54) HYDRAULIC VALVE

(75) Inventor: Leonard T. Chapman, North Hollywood, CA (US)

(73) Assignee: Chapman/Leonard Studio Equipment, North Hollywood, CA (US)

( * ) Notice: Subject to any disclaimer, the term of this patent is extended or adjusted under 35 U.S.C. 154(b) by 0 days.

(21) Appl. No.: 09/838,396

(22) Filed: Apr. 19, 2001

(65) Prior Publication Data

US 2002/0112764 A1 Aug. 22, 2002

Related U.S. Application Data

(60) Continuation-in-part of application No. 09/577,073, filed on May 23, 2000, now Pat. No. 6,247,498, which is a division of application No. 09/055,080, filed on Apr. 3, 1998, now Pat. No. 6,073,913.

(51) Int. Cl.[7] ..... F15B 13/044

(52) U.S. Cl. ..... 254/8 R; 91/457; 137/596.2; 137/636.1

(58) Field of Search ..... 137/596.2, 636.1; 91/457; 254/8 R

(56) References Cited

U.S. PATENT DOCUMENTS 639,673 A * 12/1899 Dyblie ..... 137/596.2
657,168 A * 9/1900 Lane et al. ..... 137/636.1
763,889 A * 6/1904 Hennebohle ..... 137/636.1
817,773 A * 4/1906 Hennebohle ..... 137/636.1
2,294,702 A * 9/1942 Van Der Werff ..... 137/596.2
2,569,598 A * 10/1951 Buchanan ..... 137/636.1
2,685,342 A * 8/1954 Lauck ..... 137/636.1
3,183,929 A * 5/1965 Weaver ..... 137/596.2
3,423,935 A * 1/1969 Budzich ..... 137/636.1
3,557,828 A * 1/1971 Smith ..... 137/636.1
4,109,678 A * 8/1978 Chapman ..... 137/596.2
4,747,424 A * 5/1988 Chapman ..... 137/1
6,073,913 A 6/2000 Chapman

OTHER PUBLICATIONS

Copy of International Search Report for PCT/US02/12848.

* cited by examiner

*Primary Examiner*—Gerald A. Michalsky
(74) *Attorney, Agent, or Firm*—Perkins Coie LLP

(57) ABSTRACT

An improved hydraulic valve for a camera dolly includes a valve pin having an extension within a valve housing to reduce vibration and noise and to reduce hydraulic closing forces. The valve pin is resiliently supported by e.g., rubber o-rings at both ends. Valve performance is improved as reducing hydraulic forces on the valve pin results in smooth valve operation, especially when opening the valve under heavy loading.

17 Claims, 7 Drawing Sheets

Fig. 3
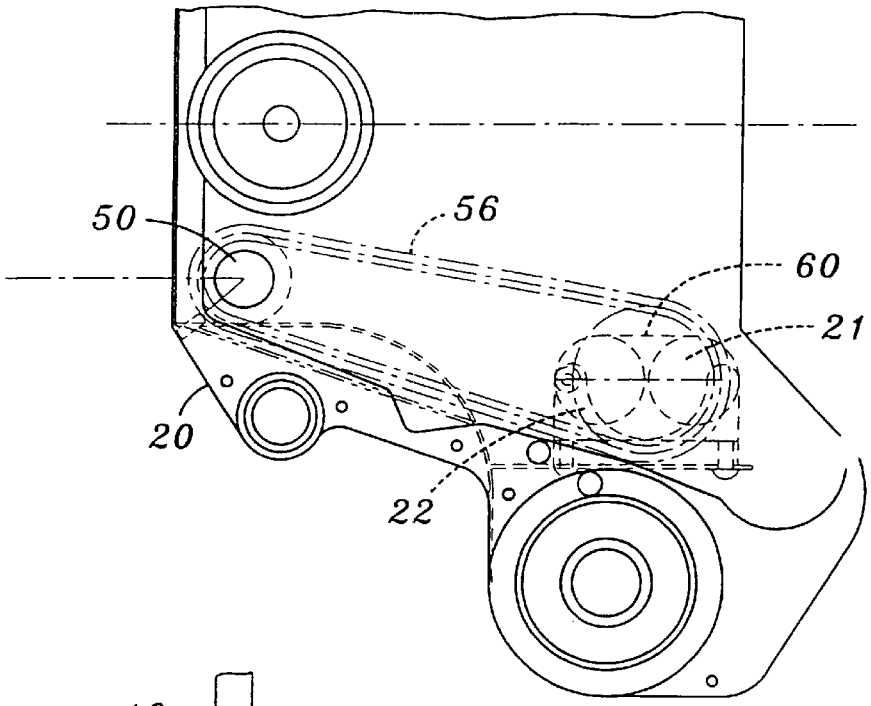
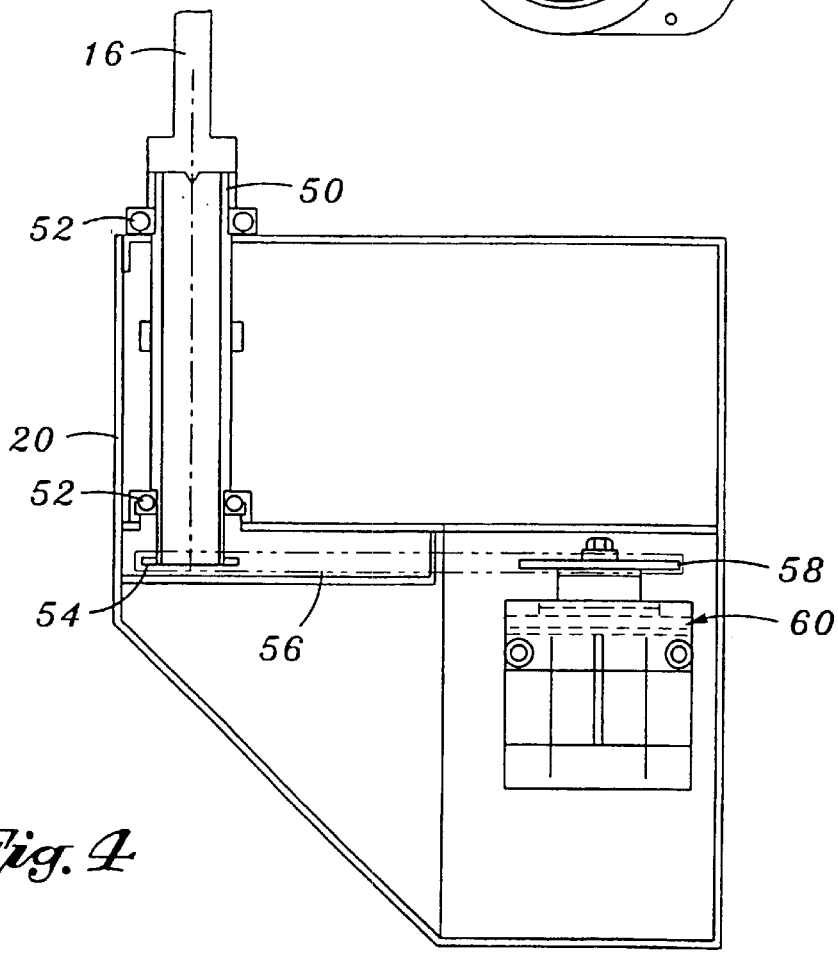
Fig. 4

HYDRAULIC VALVE

This application is a Continuation-in-Part of Ser. No. 09/577,073, filed May 23, 2000 and now U.S. Pat. No. 6,247,498, which in turn is a divisional of Ser. No. 09/055,080 filed Apr. 3, 1998, now U.S. Pat. No. 6,073,913. These Applications are incorporated herein by reference.

FIELD OF THE INVENTION

The field of the invention is hydraulic valves. More particularly, the invention relates to hydraulic valves used to control an actuator, such as a hydraulic cylinder.

BACKGROUND OF THE INVENTION

Hydraulic valves are widely used to control hydraulic actuators or cylinders, in various types of hydraulic systems. Hydraulic systems are widely used where relatively large forces are needed, such as lifting forces. Some of these hydraulic systems require precision control of the actuator, for example, hydraulic systems used in camera cranes, dollies, or pedestals.

Camera dollies are used in the television and motion picture industries to support and maneuver a camera. Typically, the camera dolly is on wheels and has an arm to raise and lower the camera. The camera dolly is generally moved by dolly operators or "grips", to properly position the camera, to follow the film or video sequence.

Various designs have been used to raise and lower a camera on a camera dolly. For example, U.S. Pat. No. 4,360,187 describes a two piece arm design for use in a camera dolly. The arm is raised and lowered via a hydraulic actuator and a control valve. Other camera dollies use a straight single piece beam arm or a telescoping pedestal lifted by a hydraulic or pneumatic actuator, such as described in U.S. Pat. No. 5,516,070.

The valves used to control a hydraulically driven camera dolly arm must meet certain design objectives. For example, the opening and closing characteristics of the valve should allow the camera dolly operator to accurately and easily control the speed and direction of the arm movement. The valve should also allow the arm to be accurately stopped at a selected elevation. In addition, the valve should operate silently, so as not to interfere with the sound track being recorded for the motion picture or video sequence.

U.S. Pat. Nos. 4,747,424 and 4,109,678, incorporated herein by reference, describe hydraulic valves which have been successfully used in camera cranes and dollies for many years. However, the valve described in U.S. Pat. No. 4,109,678 will occasionally generate fluid rushing or whistling sounds, especially on the "down" side, as hydraulic fluid rapidly flows through the valve, when the camera dolly arm is quickly lowered. These sounds can be disruptive during filming. In addition, controlling this valve to begin movement of the camera dolly arm at a precise time can require a level of skill and experience, as the control handle must be turned by a certain amount before the camera dolly arm actually begins to move. The delay between control handle movement and arm movement results because the swash plate in the valve must turn sufficiently, before the valve cracks open. This characteristic can make precise control of the movement of the camera dolly arm more difficult. As split second timing is often needed to position a camera, the delay in arm movement can be a disadvantage. The delay may also induce less experienced grips to overcompensate by turning the control handle too far. This results in arm movement that is too fast, or that overshoots the desired camera lens height.

The valve described in U.S. Pat. No. 4,109,678 is a double pin or needle valve. A first needle opens or lifts off of a seat, to move the camera dolly arm up. A second needle openings to move the camera dolly arm down. Due to the design of this valve, the second needle may pop or jump slightly, as it openings, especially when the camera dolly arm is heavily loaded. This characteristic can cause a slight but noticeable disruption in smooth downward movement of the arm. As precision camera movement is often essential in filming, it would be advantageous to avoid this characteristic entirely. Similarly, such precision actuator movement would also be advantageous in hydraulic systems used in various other commercial, industrial, scientific or military equipment.

Accordingly, there remains a need for an improved hydraulic valve to control movement of a hydraulic actuator.

SUMMARY OF THE INVENTION

To these ends, an improved three-way hydraulic valve has first and second pins within a first and second bores of a valve housing, biased into sealing engagement with first and second valve seats, respectively. A swash plate or other actuator, linked to a valve control knob or lever displaces either the first pin, to open a first side of the valve or the second pin, to open a second side of the valve. The swash plate or actuator may also be moved into a stop position, where neither pin is displaced or separated from its valve seat, to close both sides of the valve. The first pin has a head which fits into or against the first valve seat. The head is located within a valve base having a channel connecting the first and second bores. A head extension extends from the head, away from the first valve seat, and into an opening or bore in the valve base. A seal in or at the bore, such as an o-ring, seals the head extension against the valve base, while allowing axial movement of the first pin.

With this improved design, hydraulic forces acting on the first pin are reduced or eliminated, thereby providing for very smooth and consistent valve operation even under heavy loading. The first pin is also better supported within the valve housing, providing quiet operation. The seal around the head extension acts as a dampener, reducing any fluid flow induced noise or vibration. The valve may advantageously be using to control a hydraulic cylinder or actuator.

The invention resides as well in subcombinations of the features, components, assemblies, and methods described and shown.

BRIEF DESCRIPTION OF THE DRAWINGS

Other objects and features of the invention will become apparent from the following detailed description taken in connection with the accompanying drawings. It is to be understood, however, that the drawings are designed for the purpose of illustration only and are not intended as a definition of the limits of the invention.

In the drawings, wherein the same reference number indicates the same element:

FIG. 3 is a partial plan view thereof.

FIG. 4 is a side elevation thereof, in part section.

DETAILED DESCRIPTION OF THE DRAWINGS

Figure 1:
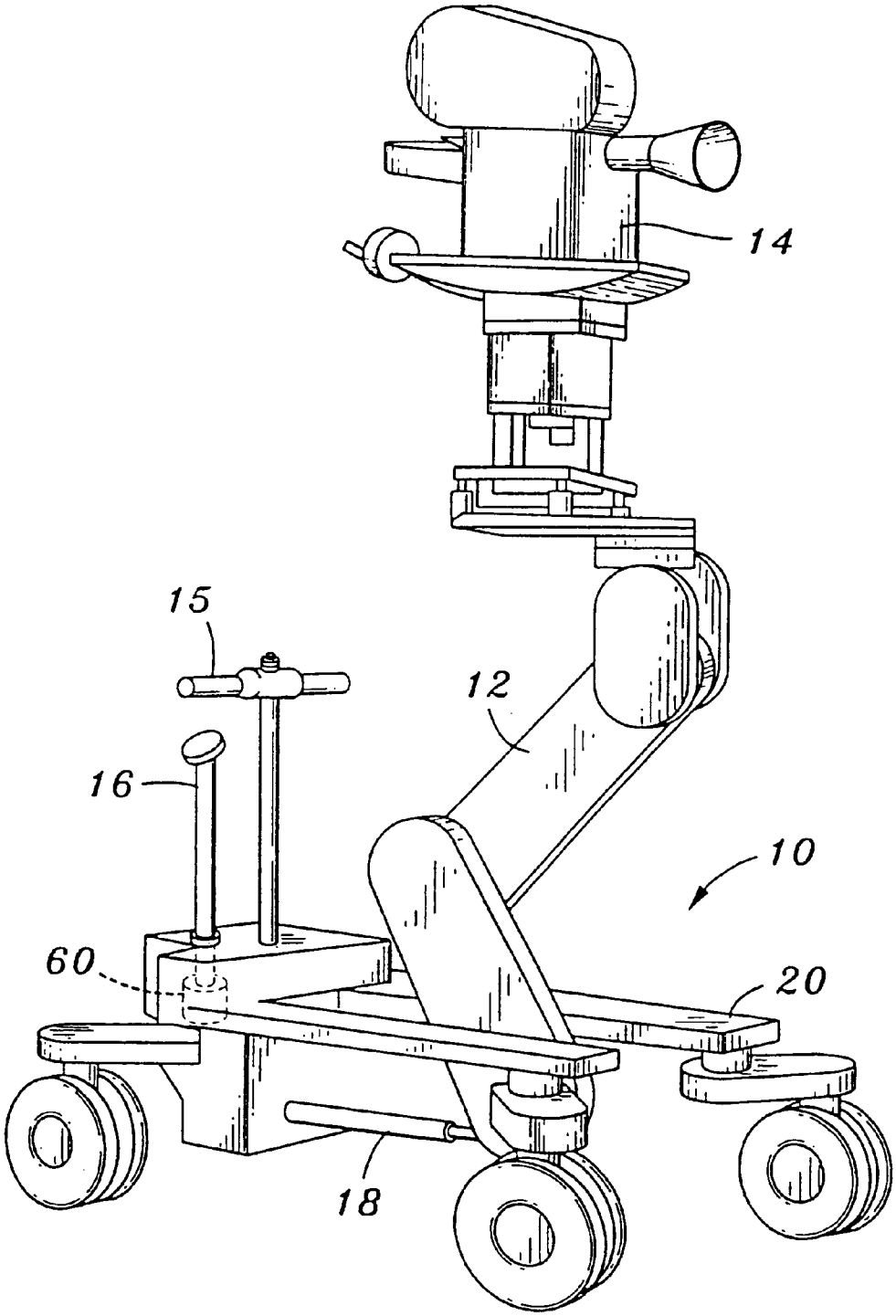
FIG. 1 is a perspective view of a camera dolly.
Figure 2:
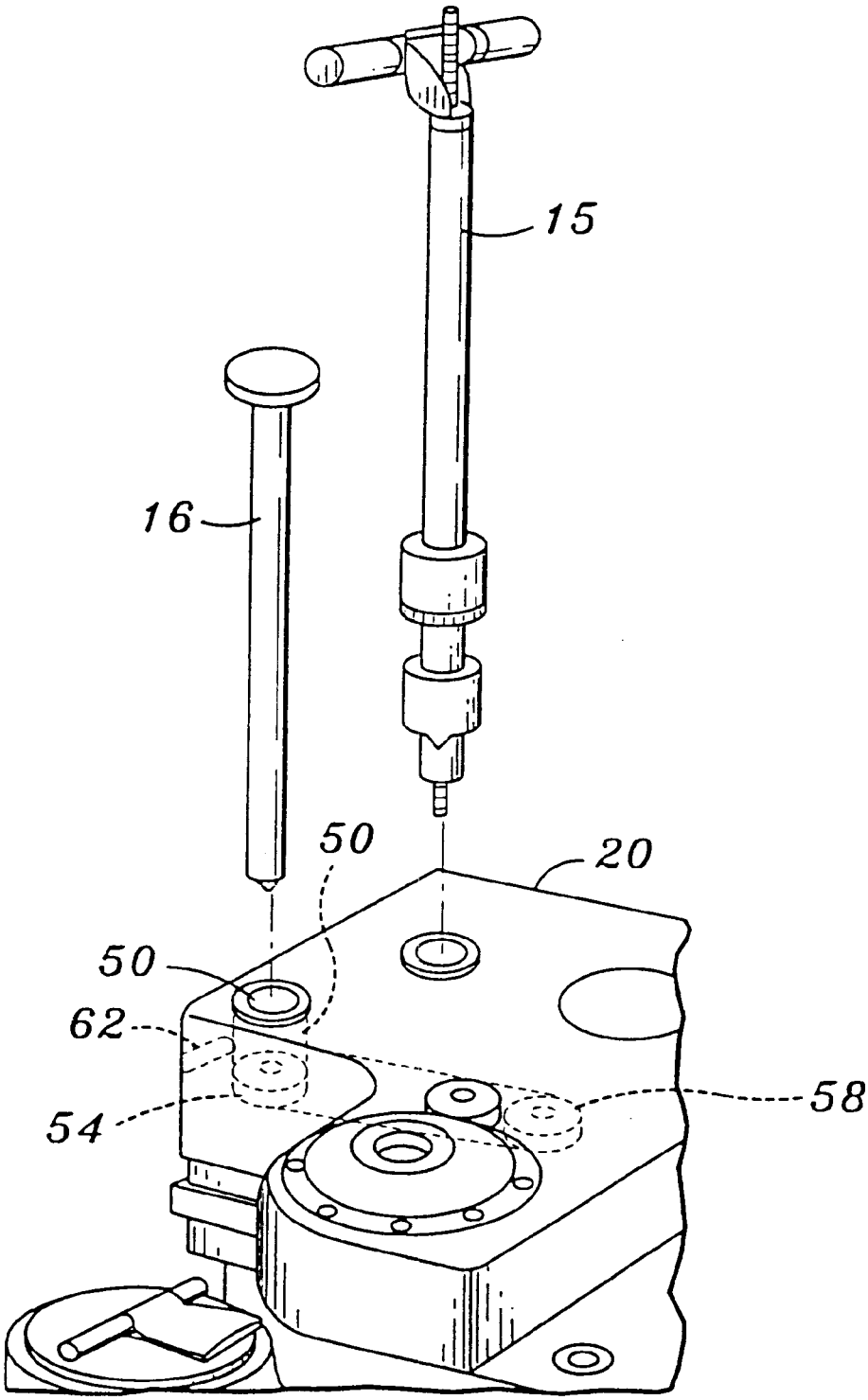
FIG. 2 is an enlarged perspective view of the back end of the camera dolly of FIG. 1, containing the present hydraulic valve.

Turning now in detail to the drawings, as shown in FIGS. 1 and 2, a camera dolly 10 has an arm 12 supporting a motion picture or video camera 14. A boom or arm control 16 at the back of the camera dolly 10 is turned to open and close a hydraulic valve 60, to raise and lower the arm 12. The hydraulic valve 60 controls the flow of hydraulic fluid to a hydraulic actuator 18 extending from the chassis 20 of the dolly 10 to the arm 12. A steering bar 15 at the back end of the dolly 10 is used to steer the wheels of the dolly, and to shift between different steering modes.

Figure 5:
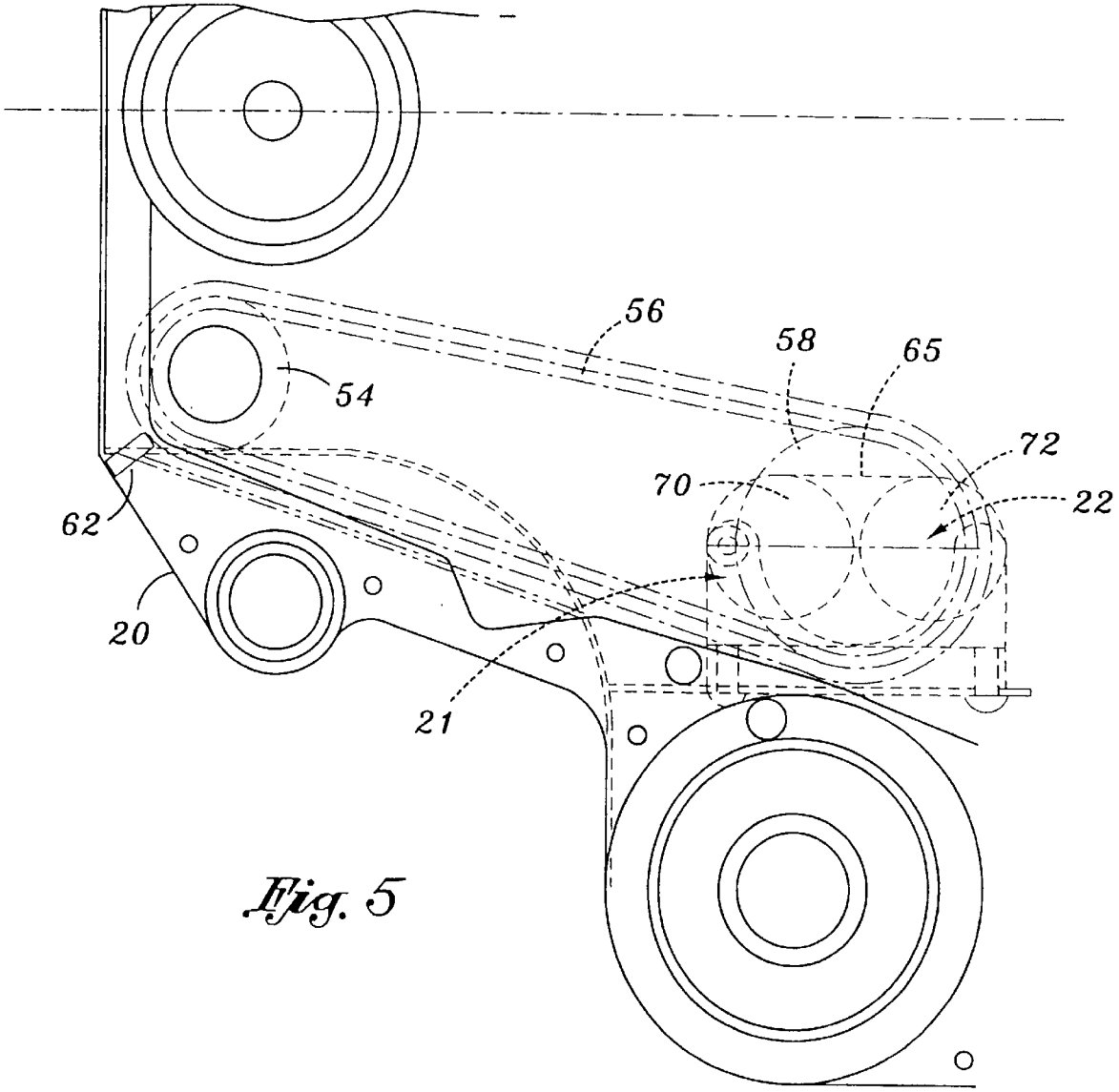
FIG. 5 is an enlarged partial plan view of the back right side of the camera dolly shown in FIG. 1.

Referring to FIGS. 3, 4 and 5, a receiver tube 50 is rotatably mounted at the back end of the chassis 20 on bearings 52. The boom control 16 is irrotatably secured to the upper end of the receiving tube 50. A boom sprocket 54, preferably having 20 teeth is irrotatably attached to the bottom end of the receiver tube 50.

A hydraulic valve 60 is mounted within the chassis 20 in front of the receiver tube 50. A valve sprocket 58, preferably having 32 teeth, is attached on top of the valve 60. The valve sprocket 58 is linked to the boom sprocket 54 via a roller chain 56.

Figure 6:
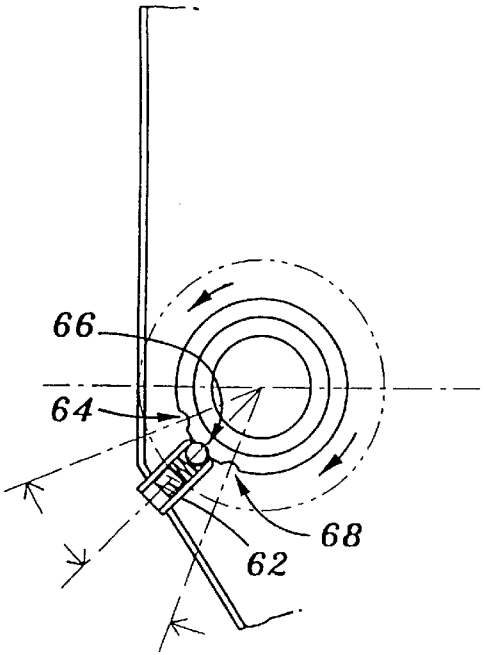
FIG. 6 is an enlarged plan view, in part section, showing details of the detent shown in FIG. 5.

Referring to FIGS. 5 and 6, the receiver tube 50 has three detent grooves or dimples: a down groove 64, a stop groove 66, and an up groove 68. A ball detent 62 on the chassis is positioned to engage these grooves.

Figure 7:
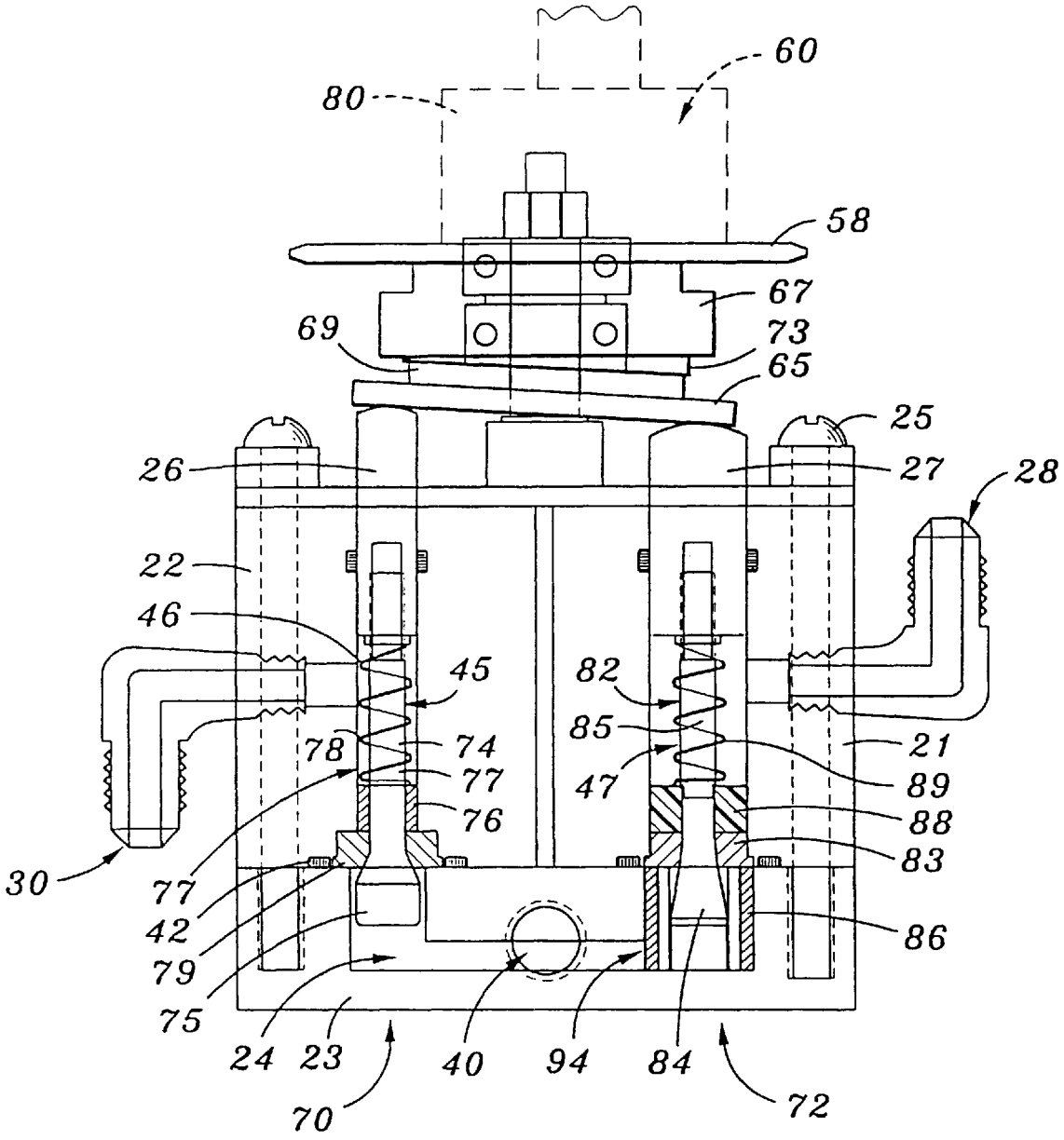
FIG. 7 is a side elevation view, in part section, of the hydraulic valve shown in FIGS. 3–5.

Referring to FIGS. 5 and 7, the hydraulic valve 60 has a valve body 22 generally divided into an up side 70 and a down side 72. A valve base 23 is bolted onto the valve body 22. A port 40 extending into the valve base 23 connects to a passageway 24 leading into an up bore 45, which connects to an up outlet 30 extending out of the valve body 22.

Similarly, on the down side 72 of the valve 60, the port 40 extends through the passageway 24 to a down bore 47 in the down valve body 21. A return port 28 extends through the down valve body 21 and joins into the down bore 47. The junctions between the passageway 24 in the valve base 23 and the up bore 45 and down bore 47 in the down valve bodies 21 and 22 are sealed by O rings 42, compressed by bolts 25 clamping the valve body and valve base together.

An up pin 74 is centered in position within the up bore 45 via a steel bushing 76 (which is preferably pressed into the up bore 45.) The bushing 76 and the shaft 77 of the up pin 74 are dimensioned to create a small annular opening around the shaft for hydraulic fluid passage. The upper end of the shaft 77 of the up pin 74 is threaded into a piston 26 which bears against a swash plate 65 which reacts against a Teflon washer 69 over the swash plate 65. The valve sprocket 58 is attached to and rotates with a cam 67. The Teflon washer 69 is sandwiched between the swash plate 65 and the eccentric bottom surface 73 of the cam 67. As the cam turns, it depresses either of the pistons 26 and 27. Alternatively, a glass filled Teflon washer or a needle bearing plate may be used in place of the Teflon washer 69, for faster valve response. The swash plate 65 generally does not turn with the valve sprocket 58. The lower end of a compression spring 46 rests on the bushing 76 with the upper end of the compression spring 46 pushing on the piston 26. A steel valve seat 79 in the valve body 22 seals the up bore 45 closed when the head 75 of the up pin 74 engages the seat 79.

Figure 9:
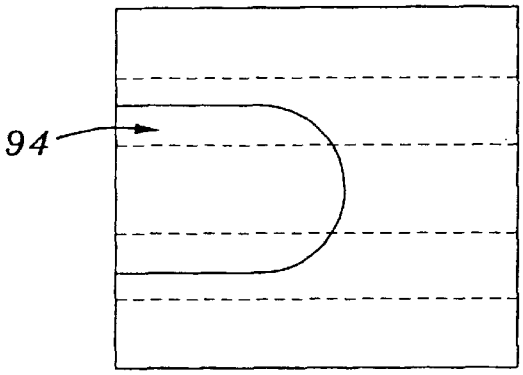
FIG. 9 is a side elevation view thereof.
Figure 8:
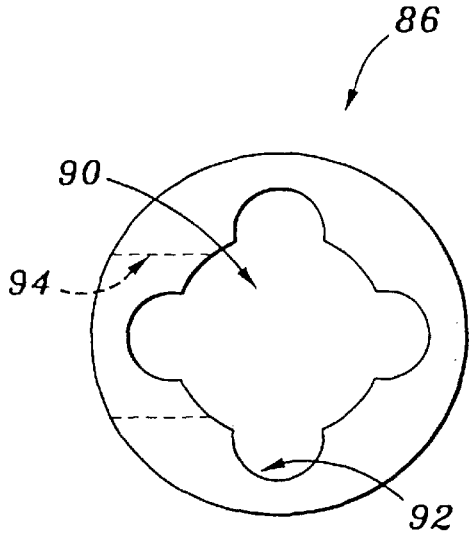
FIG. 8 is a plan view of the head insert shown in FIG. 7.

On the down side 72 of the hydraulic valve 60, a head insert 86, as shown in FIGS. 8 and 9, is pressed into the valve base 23. A head bore 90 extends through the head insert 86. The head bore 90 connects to the passageway 24 through a cutout 94 in the side cylindrical surface of the head insert 86. As shown in FIG. 8, side channels 92 extend through the head insert 86. The head bore 90 is dimensioned to closely fit around the head 84 of the down pin 82. A steel valve seat 83 is positioned in the valve body 22 above the head insert 86.

Figure 11:
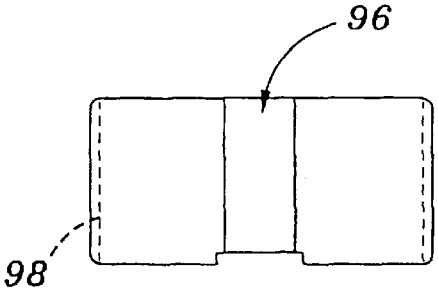
FIG. 11 is a side elevation view thereof (rotated 90°).
Figure 10:
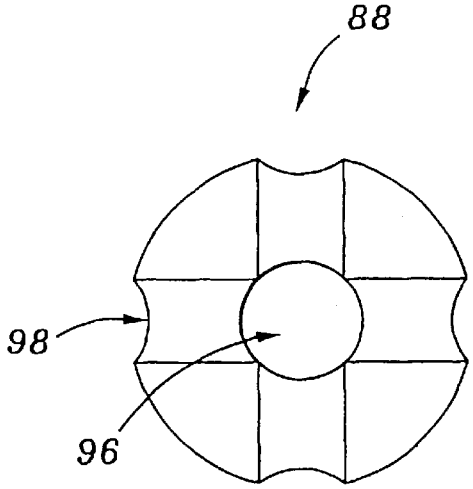
FIG. 10 is a plan view of the shaft insert shown in FIG. 7.

Referring to FIG. 7, a shaft insert 88 is pressed into the down bore 47, above the valve seat 83. The shaft insert 88, as shown in FIGS. 10 and 11, has a through bore 96, dimensioned to closely fit around the shaft 85 of the down pin 82. Grooves 98 on the outside of the shaft insert 88 allow hydraulic fluid to flow through the down bore 80 past the shaft insert 88. A piston 27 is threaded onto the upper end of the shaft 85 of the down pin 82. A spring 89 biases the down pin 82 upwardly with the piston 27 bearing against the swash plate 65.

As best shown in FIG. 5, the boom sprocket 54 is smaller than the valve sprocket 58. In the preferred embodiment, the boom sprocket 54 has 20 teeth and the valve sprocket 58 has 32 teeth. This provides a 1:1.6 ratio between turning movement of the boom control 16 and turning movement of the valve sprocket 58 and the cam 67. In prior designs, a 1:1 ratio was used, making the valve highly sensitive to movement of the boom control 16, so that even a slight movement of the boom control 16 would result in a rapid movement of the arm 12. The design shown in FIG. 5 makes operation of the dolly easier because more turning movement of the boom control 16 is needed to actuate the valve 60 and cause the arm 12 to move. As a result, the operator can more easily avoid camera positioning errors caused by the arm moving too fast or too slow. The design shown in FIG. 5 provides about 72° of boom control movement from the full speed up or down position to the stop position, in contrast to about a 45° range of movement in previous camera dollies.

In use, hydraulic lines are connected to the down outlet 28, up outlet 30 and to the port 40, to connect the valve 60 into the hydraulic system of the camera dolly 10. To raise the arm 12 of the camera dolly 10, the boom or arm control 16 is turned counterclockwise (when viewed from above as in FIG. 6). The boom control turns the receiver tube 50, and the boom sprocket 54 on the receiver tube 50. Consequently, the valve sprocket 58 turns in the same direction, and by about 62% (20 teeth/32 teeth=62%) of the amount as the boom control 16, driven by the chain 56 connecting the valve sprocket 58 to the boom sprocket 54. As the valve sprocket 58 turns, the swash plate pushes down on the piston 26 causing the head 75 of the up pin 74 to move away from the seat 79. The up side 70 of the hydraulic valve 60 is then opened, allowing hydraulic fluid to flow through the port 40, the passageway 24, through the annular space between the bushing 76 and shaft 77 of the up pin 74, through the up bore 78, and out through the up outlet 30, to drive the hydraulic actuator 18 up and raise the arm 12.

Lowering the arm is performed by turning the boom control clockwise, opening the down side of the valve, and allowing hydraulic fluid to return from the actuator, through the down bore 47, through the side channels 92 in the head insert 86, through the grooves 98 on the shaft insert 88, out of the return port 28, to a sump or reservoir.

Referring to FIGS. 2, 5–7, when the boom control 16 is turned to a position so that the detent 62 engages the stop groove 66, the swash plate 65 is positioned so that both pistons are up and both sides of the valve 60 are closed. Consequently, no hydraulic fluid can flow through the valve 60 and the arm 12 remains in a fixed position. When the boom control 16 is turned so that the detent 62 engages the up groove 68, the swash plate 65 is positioned so that the up side 70 of the hydraulic valve 60 is on the verge of opening. Further counter-clockwise turning of the boom control 16, even by a small amount, causes the up side 70 of the valve 60 to open, so that the arm 12 moves virtually simultaneously with the further turning movement of the boom control 16.

Similarly, when the boom control 16 is turned so that the detent 62 engages the down groove 68 in the receiver tube 50, the down side 72 of the hydraulic valve 60 is on the verge of opening. As the boom control 16 is turned further counter-clockwise, as shown in FIG. 6 the downside 72 of the valve 60 opens virtually simultaneously with the further turning movement. Accordingly, turning the boom control to engage the up groove 64 or down groove 68 provides a "up ready" and an "down ready" position, from which the operator knows that further movement of the boom control 16 will result in instantaneous movement of the arm 12.

In contrast, in previous camera dolly designs, substantial turning movement of the boom control was required to move the swash plate 65 to open the up or down side of the valve. This delay in the prior designs between turning the boom control and achieving arm movement made precise timing of arm movements difficult. The grooves 64–68 and detent 62 eliminate the delay and make precise timing of arm movements easier to achieve for the dolly operator.

When the receiver tube 50 is positioned with the detent 62 engaged into the down groove 68 or the up groove 64, no hydraulic fluid flows through the valve 60. The stop groove 66 is provided in between the up groove 64 and the down groove 68 as an additional tactile point of reference. The valve 60 remains closed at all angular positions of the receiver tube 50 between (and including) the down groove 68 and the up groove 64.

The arm 12 can move down rapidly, when the valve 60 is fully opened and the arm is carrying a heavy load. In existing designs, the down pin 82 will frequently vibrate due to the turbulent and rapid flow of hydraulic fluid around the down pin. This vibration creates unwanted noise. The head insert 86 and the shaft insert 88, preferably made of Teflon, largely prevent vibration of the down pin 82 and associated noise. Consequently, the valve 60 operates silently under virtually all conditions.

If a needle bearing 69 is used in place of a Teflon washer 69 between the swash plate 65 and the cam 67, the valve 60 may tend to close itself, when the operator releases the boom control knob, depending on the friction in the mechanical position, hydraulic pressure, and valve position. The up force on the pistons generated by hydraulic pressure and the springs 46 and 89, creates a certain level of closing torque on the cam 67 and sprocket 58. This torque will close the valve unless it is exceeded by the piston/swash plate; chain/sprocket; bearings; and o-ring friction forces. This self-closing can be prevented by increasing tension in the chain 56 which will increase the friction acting to prevent the cam 67 from turning. A viscous fluid 80 dampener may optionally also be linked to the swash plate, to provide a smooth and controlled closing movement of the valve.

Figure 12:
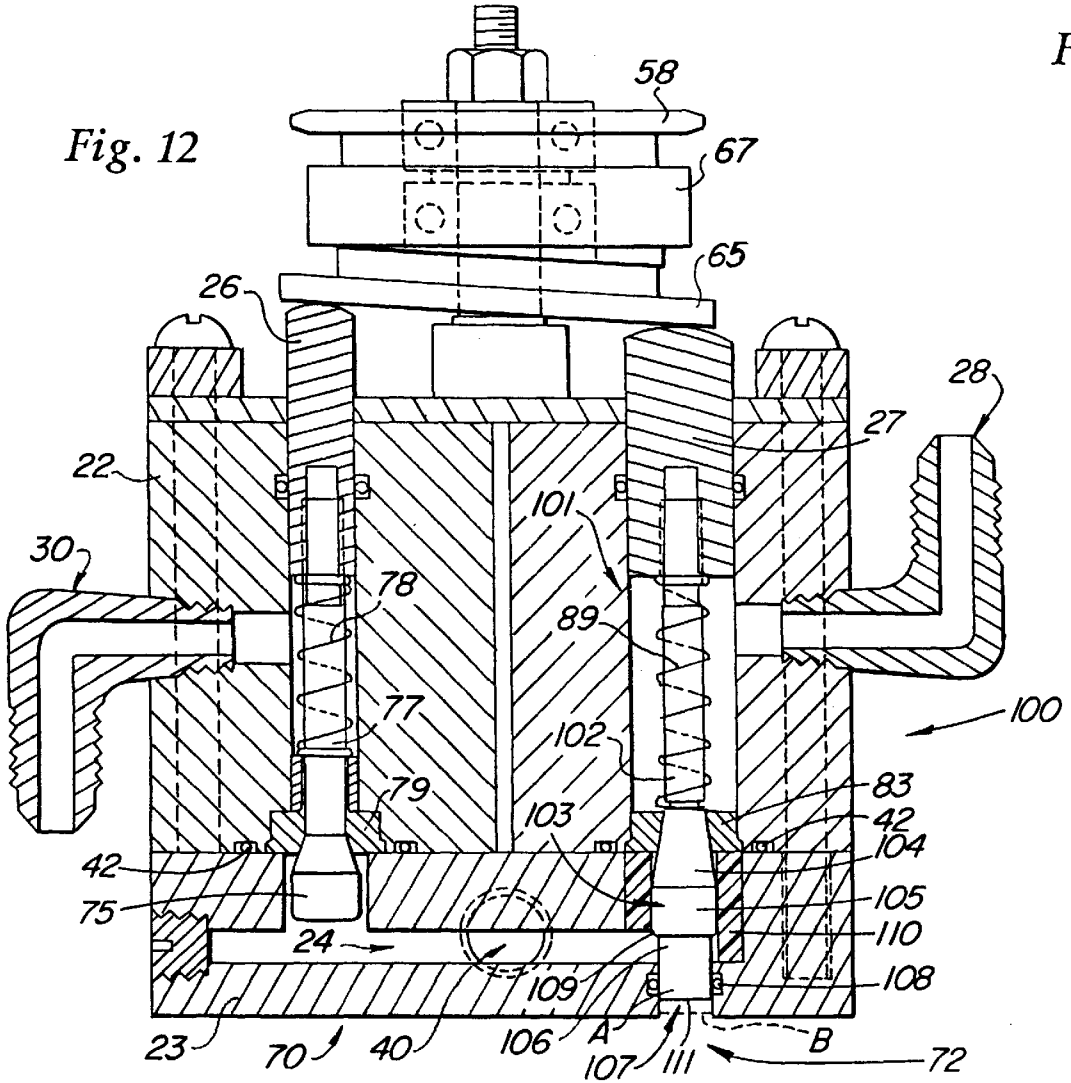
FIG. 12 is a side elevation view, in part section, of another valve design.

FIG. 12 shows an alternative valve 100 having improved performance. The valve 100 is the same as the valve shown in FIG. 7 and described above, except for the following features. The first or down pin 102 has a head 103 including a tapered section 104 and a cylindrical section 105. The tapered section 104 is adapted to engage and seal against the seat 83, forming a down valve assembly 101, (along with the spring 89). A head sleeve 110 (preferably Teflon) in the valve base 23 surrounds the head 103 to help prevent vibration during turbulent flow. A fluid passage extends through the sleeve 110, so that hydraulic fluid can pass between the cylinder port 40 and the return line port 28, when the down valve assembly 101 is open. An extension 106 having an end face 111 extends from the head 103 into an opening 107 in the valve base 23. A seal or o-ring 108 in the valve base 23 seals against the extension 106.

Figure 13:
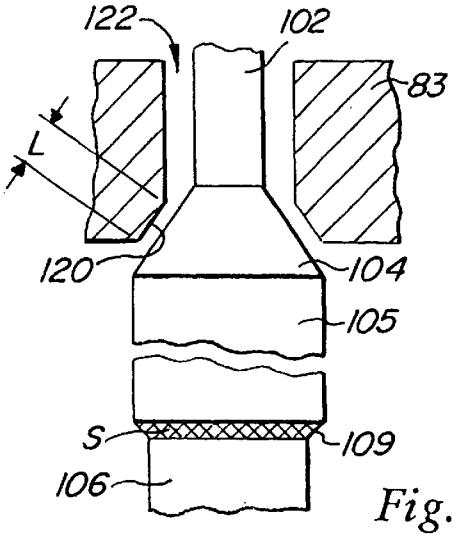
FIG. 13 is an enlarged partial section view of the valve of FIG. 12, shown in the open position.

Referring to FIG. 13, the seat 83 has an annular conical flat contact section 120 concentric with the tapered section 104 and a straight wall bore 122 extending through the seat 83. The bore 122 is drilled through the seat 83. The flat contact section 120 is then added via grinding, so that the bore 122 and flat contact section 120 are precisely concentric. The cone angle of the tapered section matches the cone angle of the contact section on the seat 83. The flat contact section 120 has a length L of about 0.003–0.050 inches, or 0.005–0.040 inches, and more preferably about 0.010–0.030 inches. Consequently, the valve assembly 101 makes a thin line or ring of contact between the seat 83 and the pin 102. The very small area contact between the flat contact section 120 and the tapered section 104 of the pin 102 allows the valve to close and seal with only light force. The small contact area between them also makes the valve assembly 101 less subject to internal damage or leaking, due to the valve closing on a particle contaminant. The valve assembly 101 provides a precision metal-to-metal seal, which is highly reliable and durable, even at high pressures.

The o-ring or seal 108 around the extension 106 of the pin 102 prevents hydraulic fluid leakage from the passageway 24 out through the opening 107 in the base 23. It also further supports the head 103 against any radial direction movement. The seal 108 also helps dampen any noise or vibration that may arise in the pin 102, e.g., from fluid movement around the pin 102. The extension 106 slides axially through the seal 108, from position A in FIG. 12, when the valve assembly 101 is closed, to position B, when the valve assembly 101 is open. The base 23 may be made as part of the valve housing.

The hydraulic axial closing force acting on the pin 102 is a linear function of the projected area of the pin 102 in the passageway 24. In the valve of FIG. 7, the high pressure hydraulic fluid in the passageway 24, which can reach 3000 or 4000 psi, acts upwardly on a projected area of the pin 82 equal to the area of the end face of the head 84. This hydraulic pressure also acts downwardly on the projected area of the tapered section, below the flat contact section 120, in the passageway 24. However, as the area of the end face of the head 84 is much greater than the projected area of the tapered section of the pin 82, the hydraulic force pushing the pin against the seat is substantial, e.g., about 30–200 lbs. Due to the small contact area between the pin and the seat, strain or deformation of the pin and seat materials can result, causing less than optimal performance.

The valve 100 shown in FIG. 12 overcomes these disadvantages, because it is designed so that the hydraulic up or closing force acting on the pin is substantially entirely balanced out by the hydraulic down or opening force on the pin.

Figure 14:
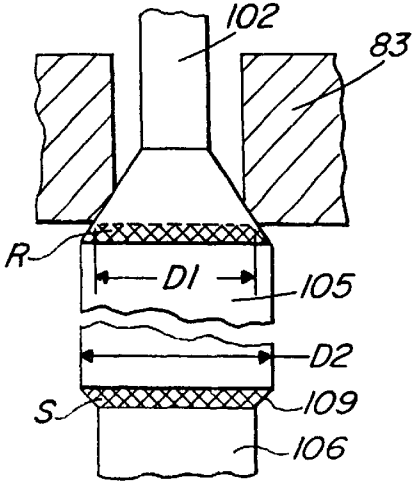
FIG. 14 is a similar view showing the valve in the closed position.

The valve 100 in FIG. 12 works in the same way as the valve of FIG. 7. However, due to the extension 106 forming the shoulder 109, the hydraulic force pushing the head 103 into engagement with the seat 83, is reduced or eliminated entirely. The projected or end face area of the shoulder 109 (indicated as the shaded area S in FIGS. 13 and 14) on which the fluid pressure can act, when the valve assembly 101 is closed, preferably is from 80% to 120% and more preferably is equal to the projected surface area of the tapered section 104 extending below the contact section 120 (indicated as the shaded area R in FIGS. 13 and 14). In this way, the force from the fluid pressure acting on pin 102, when the valve is closed, is at or near zero. Stated differently, the diameter of the extension 106 is preferably equal to the diameter of the orifice in the seat 82, typically about 0.2–0.3 or 0.25 inches. The projected area of R is equal to $(D2/2)^2\Pi-(D1/2)^2\Pi$.

As the valve 100 shown in FIG. 12 has little or no hydraulic force acting on the pin 102, the valve performance is relatively unaffected by the fluid pressure. Even with high fluid pressures, (as encountered when the camera dolly arm carries a heavy camera payload), the pin 102 closes and seals against the seat 83 with a force largely exerted by the spring 89. Wedging of the head into the seat, and excessive strain of head and seat materials, which can occur in the valve of FIG. 7, are eliminated with the valve 100 in FIG. 12. As a result, any pop or jump action of the down valve assembly 101 is avoided, regardless of loading and operating conditions. The up valve assembly in the valve 100 shown in FIG. 12 may be the same as shown in FIG. 7, or it may be the same as the down valve assembly 101 shown in FIG. 12. Unlike conventional valves, the pin 102 moves axially, with no rotation or angular movement. Wear on the sealing surfaces is minimal, resulting in a very long service life. Moreover, less movement is needed to open or close the valve.

Thus, a novel hydraulic valve for a camera dolly has been shown and described. Various modifications and substitutions of equivalents may of course be made without departing from the spirit and scope of the invention. The invention, therefore, should not be restricted, except by the following claims and their equivalents.

What is claimed is:

1. A camera dolly comprising:

an arm for supporting a camera;

a hydraulic actuator attached to the arm; and a hydraulic valve for controlling flow of hydraulic fluid to and from the hydraulic actuator, with the hydraulic valve comprising:

a housing:

a pressure port connecting into a first bore in the housing;

an exhaust port connecting into a second bore in the housing;

a passageway connecting the first bore and the second bore;

an actuator port connecting into the passageway, between the first bore and the second bore;

a first seat at the first bore;

a first pin engageable against the first seat, to seal the first bore from the passageway, and movable away from the first seat, to allow fluid flow between the first bore and the passageway;

a first spring urging the first pin into engagement against the first seat; a second seat at the second bore;

a second pin engageable against the second seat, to seal the second bore from the passageway, and movable away from the second seat, to allow fluid flow between the second bore and the passageway; and a second spring urging the second pin into engagement against the second seat, with the second pin having a head and a solid extension therefrom extending through an opening in the housing and through a second pin seal surrounding the opening, the extension reducing the area of the head that is exposed to hydraulic force.

2. The camera dolly of claim 1 further including a valve base on the housing, with the second pin seal in the valve base of the housing.

3. A camera dolly comprising:

an arm;

a hydraulic actuator linked to the arm;

a hydraulic valve controlling flow of hydraulic fluid to and from the hydraulic actuator;

with the hydraulic valve including:

a valve body;

an up pin in an up bore of the valve body;

a down pin in a down bore of the valve body, and with the up and down pins each having a head biased into sealing engagement with an up seat and a down seat, respectively;

a valve base on the valve body, with the valve base having a through hole;

a solid extension on the head of the down pin extending into the through hole in the valve base, the extension reducing the area of the head on the down pin that is exposed to hydraulic force; and a seal in the through hole of the valve base around the extension.

4. The camera dolly of claim 3 where the head on the down pin has a cylindrical section and an annular shoulder on the cylindrical section around the extension and where the extension has a diameter less than the diameter of the cylindrical section.

5. The camera dolly of claim 4 where the head of the down pin has a tapered section and the shoulder has a projected area on which fluid within the valve body can act, which is from 80% to 120% of the projected area of the tapered section of the head, which remains exposed to fluid pressure, when the tapered section is engaged into the down seat.

6. The hydraulic valve of claim 3 wherein the down seat has an opening having a first diameter and a second diameter spaced apart from, and smaller than, the first diameter, and wherein the first diameter is substantially equal to the diameter of the extension.

7. A camera dolly comprising:

an arm;

a hydraulic actuator linked to the arm;

a hydraulic valve controlling flow of hydraulic fluid to and from the hydraulic actuator;

with the hydraulic valve including:

a valve body having first and second bores, each bore having a valve seat;

a valve base on the valve body having a through hole;

a first pin slideable within the first bore and having a first head biased into sealing engagement with the valve seat of the first bore;

a second pin slideable within the second bore and having a first end and an opposing second end;

a piston coupled to the first end;

a second head extending from the second end;

a spring disposed about the second pin for biasing the second head against the valve seat of the second bore;

a solid extension extending from the second head away from the valve seat of the second bore, the extension reducing the area of the second head that is exposed to hydraulic force; and a seal disposed in the through hole of the valve base around the extension.

8. The camera dolly of claim 7 wherein the second head includes a tapered section, a cylindrical section, and an annular shoulder, the diameter of the extension being less than the diameter of the cylindrical section.

9. The camera dolly of claim 8 wherein the shoulder has a projected area on which fluid within the valve body can act, which is from 80% to 120% of the projected area of the tapered section, which remains exposed to fluid pressure, when the tapered section is engaged into the valve seat of the second bore.

10. A camera dolly comprising:

an arm;

a hydraulic actuator linked to the arm;

a hydraulic valve controlling flow of hydraulic fluid to and from the hydraulic actuator, the hydraulic valve including:

a valve body;

a first bore in the valve body;

a first pin in the first bore, the first pin having a first head on a first end thereof;

a second bore in the valve body;

a second pin in the second bore, the second pin having a second head on a first end thereof;

a first valve seat in the first bore, with the first head biased into sealing engagement with the first valve seat;

a second valve seat in the second bore, with the second head biased into sealing engagement with the second valve seat;

a valve base on the valve body, with the valve base having a through hole;

an extension on the second head extending into the through hole, the extension reducing the surface area on the second head that is subjected to hydraulic force; and a seal in the through hole sealing against the extension.

11. The camera dolly of claim 10 further comprising a first spring disposed about the first pin and a second spring disposed about the second pin for biasing the first head and the second head against the first valve seat and the second valve seat, respectively.

12. The camera dolly of claim 11 further comprising a first piston coupled to a second end of the first pin for pushing the first pin to move the first head away from the first valve seat, and a second piston coupled to a second end of the second pin for pushing the second pin to move the second head away from the second valve seat.

13. The camera dolly of claim 10 wherein the second head includes a tapered section, a cylindrical section, and an annular shoulder, the diameter of the extension being less than the diameter of the cylindrical section.

14. The camera dolly of claim 13 wherein, when the tapered section is engaged into the second valve seat, the shoulder has a projected area on which fluid within the valve body can act that is from 80% to 120% of a projected area of the tapered section that remains exposed to fluid pressure.

15. The camera dolly of claim 10 wherein the extension is axially slidable within the seal.

16. The camera dolly of claim 10 wherein the seal comprises an O-ring.

17. A camera dolly comprising:

an arm;

a hydraulic actuator linked to the arm;

a hydraulic valve controlling flow of hydraulic fluid to and from the hydraulic actuator;

with the hydraulic valve including:

a valve body;

an up pin in an up bore of the valve body;

a down pin in a down bore of the valve body, and with the up and down pins each having a head biased into sealing engagement with an up seat and a down seat, respectively;

a valve base on the valve body, with the valve base having a through hole;

a cylindrical solid extension on the head of the down pin extending into the through hole in the valve base, the solid extension having a uniform diameter throughout and reducing the area of the head of the down pin that is exposed to hydraulic force; and a seal in the through hole of the valve base sealing against the extension.

* * * * *